US009466449B2

(12) United States Patent
Hasenkopf

(10) Patent No.: US 9,466,449 B2
(45) Date of Patent: Oct. 11, 2016

(54) DRIVE CIRCUIT FOR N CONTACTORS AND A METHOD FOR DRIVING N CONTACTORS

(71) Applicants: Robert Bosch GmbH, Stuttgart (DE); Samsung SDI Co., Ltd., Yongin-si, Gyeonggi-do (KR)

(72) Inventor: Dirk Hasenkopf, Stuttgart (DE)

(73) Assignees: Robert Bosch GmbH, Stuttgart (DE); Samsung SDI Co., Ltd., Yongin-si, Gyeonggi-do (KR)

( * ) Notice: Subject to any disclaimer, the term of this patent is extended or adjusted under 35 U.S.C. 154(b) by 0 days.

(21) Appl. No.: 14/436,200

(22) PCT Filed: Sep. 8, 2013

(86) PCT No.: PCT/EP2013/068539

§ 371 (c)(1),
(2) Date: Apr. 16, 2015

(87) PCT Pub. No.: WO2014/060145

PCT Pub. Date: Apr. 24, 2014

(65) Prior Publication Data

US 2015/0294821 A1 Oct. 15, 2015

(30) Foreign Application Priority Data

Oct. 18, 2012 (DE) ..... 10 2012 218 987

(51) Int. Cl.

| | |
|---|---|
| ***H01H 47/00*** | (2006.01) |
| ***H01H 47/22*** | (2006.01) |
| ***H01H 47/04*** | (2006.01) |
| ***H01H 47/32*** | (2006.01) |

(52) U.S. Cl.

CPC ..... *H01H 47/22* (2013.01); *H01H 47/04* (2013.01); *H01H 47/325* (2013.01)

(58) Field of Classification Search

CPC ..... H01H 47/22
USPC ..... 361/160
See application file for complete search history.

(56) References Cited

U.S. PATENT DOCUMENTS

| | | | | |
|---|---|---|---|---|
| 5,671,115 | A | 9/1997 | Streich | |
| 7,522,435 | B2 * | 4/2009 | Kohnotoh | H02J 7/0065 363/71 |
| 7,786,699 | B2 * | 8/2010 | Demers | H02J 7/0014 320/116 |
| 2006/0055246 | A1 * | 3/2006 | Jansen | B60L 3/0023 307/87 |
| 2009/0262480 | A1 | 10/2009 | Yang | |
| 2014/0091751 | A1 * | 4/2014 | Workman | H02J 7/0013 320/106 |

FOREIGN PATENT DOCUMENTS

| | | |
|---|---|---|
| DE | 10 2009 043 553 A1 | 3/2011 |
| DE | 10 2010 041 018 A1 | 3/2012 |
| JP | 2011-129268 A | 6/2011 |

OTHER PUBLICATIONS

International Search Report corresponding to PCT Application No. PCT/EP2013/068539, mailed Nov. 22, 2013 (German and English language document) (7 pages).

* cited by examiner

*Primary Examiner* — Stephen W Jackson
(74) *Attorney, Agent, or Firm* — Maginot, Moore & Beck LLP

(57) ABSTRACT

The disclosure provides a drive circuit for n contactors, which circuit comprises a first input and a second input as well as n first connections and n second connections, wherein a first connection and a second connection in each case can be respectively connected to one of the two connections of a drive coil of one of the n contactors in each case. According to the disclosure, the drive circuit also comprises an adjustable holding voltage source, the first pole of which is connected to the second input and the second pole of which is connected to the first of the first connections. A method for driving n contactors is also disclosed.

12 Claims, 2 Drawing Sheets

DRIVE CIRCUIT FOR N CONTACTORS AND A METHOD FOR DRIVING N CONTACTORS

This application is a 35 U.S.C. §371 National Stage Application of PCT/EP2013/068539, filed on Sep. 9, 2013, which claims the benefit of priority to Serial No. DE 10 2012 218 987.4, filed on Oct. 18, 2012 in Germany, the disclosures of which are incorporated herein by reference in their entirety.

The present disclosure relates to a drive circuit for n contactors, wherein the drive circuit comprises an adjustable holding voltage source, to which the drive coils of the n contactors are connectable in a holding mode, and to a method for driving n contactors.

BACKGROUND

It is to be expected that in the future battery systems or batteries on which very stringent demands in respect of reliability will be made will be used increasingly both in stationary applications and in vehicles such as hybrid and electric vehicles. The background for this consists in that a failure of the battery can result in a safety-relevant problem. In order to provide the powers desired for a respective application, in general a high number of battery cells are connected in series within a battery, as a result of which a high output voltage of the battery is produced, which, without any suitable measures, is present permanently at the corresponding supply lines of the apparatus supplied by the battery and can pose a risk to maintenance personnel or users. For this reason, contactors are generally provided in order to be able to electrically decouple the battery. In motor vehicles with an electric drive motor, contactors are usually installed both at the positive terminal and at the negative terminal of the battery, which contactors are rated for the high voltage of the battery and also need to be able to disconnect the battery reliably in the event of short-circuit currents of over 1000 A.

The switching-on and switching-off of contactors generally takes place via an electronic output stage or via a drive circuit, which supplies current to the drive coils of the contactors. The drive power is in this case not negligibly low. During a switch-on operation, however, much higher drive currents are required for reliable attraction of the contactors than for subsequently holding the contacts in the closed state. For this reason, it is conventional to divide the driving of the contactors into two modes, the attraction mode and the holding mode (also referred to as attraction phase and holding phase, respectively). An indication of the respective mode consists in the level of the drive current, which is higher during the attraction mode than during the holding mode. In this case, the terms attraction level and holding level are used. In this case, the attraction mode is only required for switching-on (closing) of the contactors and has a relatively short duration. For the majority of the use time, the contactors are operated in the power-saving holding mode. A drive circuit for driving contactors should therefore be capable of providing both operating modes.

DE 10 2010 041 018 A1 discloses an apparatus for driving a contactor which comprises a holding current unit, which is designed to output a holding current for the drive coil of a contactor at one of its output-side outputs. With the apparatus disclosed in DE 10 2010 041 018 A1, the driving of at least one contactor during the attraction phase and during the holding phase can be performed with different voltage levels of constant voltages in an advantageous manner.

However, the component parts used, for example, in the apparatus disclosed in DE 10 2010 041 018 A1, in particular the winding resistors of the drive coils of the contactors, have a temperature dependence and in each case a manufacturing-related scatter of their component part parameters. In addition, the holding voltage generated by the holding current unit is adjusted to a value which is fixed for the production time.

The component parts used therefore need to be configured in such a way that the required holding current can be provided by the holding current unit even in the case of the presence of extreme temperatures. Since, however, the conductivity of the component parts and as a result the current flow through said component parts, such as through the drive coil of the contactor, for example, fluctuates depending on the temperature, it is necessary to dimension the component parts to be larger than would be necessary for the actually desired current. For example, the component parts used in the holding circuit of the apparatus disclosed in DE 10 2010 041 018 A1 for this reason need to be dimensioned so as to be up to 66% larger, which significantly increases the required installation space and the costs for the component parts.

SUMMARY

In accordance with the disclosure, a drive circuit for n contactors is provided which comprises a first and a second input for connection to an energy store. In addition, the drive circuit comprises n first and n second connections, wherein in each case one first and one second connection is connectable to in each case one of the two connections of in each case one drive coil of one of the n contactors. Furthermore, the drive circuit comprises n first switching means, whose in each case first connection is connected to the first input, wherein the second connection of the i-th first switching means is connected to the i-th first connection of the drive circuit. The drive circuit has n second switching means, whose in each case first connection is connected to the second input, wherein the second connection of the i-th second switching means is connected to the i-th second connection of the control circuit, wherein the i-th second connection is connected to the (i+1)th first connection, and wherein $0<i\leq n$, and i, n are natural numbers from the set of natural numbers N. In accordance with the disclosure, the drive circuit also comprises an adjustable holding voltage source, whose first terminal is connected to the second input and whose second terminal is connected to the first of the first connections.

The advantage of such a drive circuit is provided in that it enables the operation of n preferably identical contactors in an attraction mode and a holding mode with reduced complexity in terms of component parts. By virtue of the drive coils of the contactors being connected in series during the holding mode, only one adjustable holding voltage source is required irrespective of the number of contactors, by means of which holding voltage source the precise adjustment of the current flow or the holding current through the drive coils connected to the drive circuit is made possible. In other words, it is possible by virtue of the drive circuit according to the disclosure to operate n contactors on only a single adjustable holding voltage in the holding mode. By virtue of the fact that the drive coils of the n contactors are connectable in series within the drive circuit according to the disclosure, only one current control loop is required for the operation of n contactors in the holding mode.

Preferably, the adjustable holding voltage source is connected to a measurement and actuation unit, which is configured to measure the actual current flowing through the electrical connection between the first terminal of the adjustable holding voltage source and the second input of the drive circuit and to compare this actual current with a predetermined setpoint current and to adjust the holding voltage of the adjustable holding voltage source depending on the result of this comparison. Therefore, the holding current through the drive coils of the contactors can be adjusted to an optimum value at any time, as a result of which savings can be made in respect of energy and costs.

In a preferred embodiment, the drive circuit also comprises n diodes, wherein the i-th diode is in the electrical connection between the i-th second connection and the (i+1)-th first connection, wherein the anode of the i-th diode is connected to the second connection of the i-th second switching means, while the cathode of the i-th diode is connected to the second connection of the (i+1)-th first switching means.

Preferably, the electrical connection between the second terminal of the adjustable holding voltage source and the first of the first connections has a diode, whose anode is connected to the second terminal of the adjustable holding voltage source and whose cathode is connected to the first of the first connections. By virtue of such an arrangement of diodes, the current within the drive circuit can only flow in one direction.

Preferably, the drive circuit also comprises n−1 freewheeling diodes, wherein the i-th freewheeling diode is connected in parallel with the i-th second switching means, where $i \leq n-1$. The advantage of the use of freewheeling diodes consists in that, by virtue of said freewheeling diodes, high currents can be limited very precisely to a predetermined value or can be dissipated to ground. In addition, the freewheeling diodes provide compensation paths, which are required during times in which the current of the control coil i, coming from its attraction value, is adjusted to the holding current of the contactor (i−1).

Preferably, the n freewheeling diodes are in the form of zener diodes, and a further zener diode is connected in parallel with the n-th second switching means, wherein the anode of this zener diode is connected to the second input of the drive circuit. By virtue of a zener diode, voltages can be limited very precisely to a prefixed value. In addition, such an embodiment of the drive circuit enables optimized disconnection of the contactors.

In a preferred embodiment, the n-th second connection is connected to the anode of a further diode, whose cathode is connected to the first input of the drive circuit.

Preferably, the drive circuit also comprises n further freewheeling diodes, wherein the cathodes of the further freewheeling diodes are connected to the first input of the drive circuit, while the anode of the i-th further freewheeling diode is connected to the cathode of the i-th freewheeling diode, the anode of the i-th diode and the i-th second connection. Such an embodiment of the drive circuit also enables optimized disconnection of the contactors.

In addition, the disclosure provides a method for driving n contactors, wherein the method comprises the following method steps: beginning a switch-on operation, connecting the drive coil of a first of the n contactors in parallel with an energy store by means of a first group of in each case two switching means, connecting the drive coil of the first of the n contactors in series with an adjustable holding voltage source and interrupting the parallel circuit comprising the drive coil and the energy store by means of the first group of in each case two switching means once a predetermined duration T has elapsed, connecting a further drive coil of a further of the n contactors in parallel with the energy store by means of a further group of in each case two switching means, connecting the further drive coil of the further of the n contactors in series with the adjustable holding voltage source and with the previously series-connected drive coil and interrupting the parallel circuit comprising the further drive coil and the energy store by means of the further group of in each case two switching means once a predetermined duration T has elapsed, increasing the holding voltage generated by the adjustable holding voltage source, beginning the method again with the step of connecting a further drive coil of a further of the n contactors in parallel, ending the switch-on operation as soon as the drive coils of all of the n contactors are connected in series with one another and in series with the adjustable holding voltage source and the holding voltage generated by the adjustable holding voltage source has been increased once the drive coil of the n-th contactor has been connected in series.

In a preferred development of the above method for driving n contactors, in the steps of connecting in series the drive coil of the first of the n contactors and of the connecting in series of the further drive coils, the predetermined duration T results from the equation $T=L_{Si}/R_{Si}$, where $L_{Si}$ corresponds to the inductance of the drive coil to be connected in series in each case, and $R_{Si}$ corresponds to the equivalent resistance of the drive coil to be connected in series in each case. In other words, T corresponds to the time constant after which the attraction current through a contactor has decreased to a value of 69.3% of the full attraction current.

In a preferred development of the above method for driving n contactors, in the step of increasing the holding voltage generated by the adjustable holding voltage source, the holding voltage is increased to such an extent that the actual current flowing through the series circuit comprising the adjustable holding voltage source and the drive coils corresponds to a predetermined setpoint current.

In a preferred development of the above method for driving n contactors, the method furthermore comprises the steps of beginning a disconnection operation, and decoupling the drive coil which was last connected in the step of connecting the further drive coil in series from the adjustable holding voltage source by opening the switching means in the corresponding group of in each case two switching means. Furthermore, the method comprises the steps of reducing the holding voltage generated by the adjustable holding voltage source, and decoupling that drive coil from the adjustable holding voltage source which was last connected prior to the last decoupled drive coil in the step of connecting in series the further drive coil by opening the switching means in the corresponding group of in each case two switching means. In addition, the method comprises the steps of further reducing the holding voltage generated by the adjustable holding voltage source, and beginning again the method with the step of decoupling that drive coil from the adjustable holding voltage source which was last connected prior to the last decoupled drive coil in the step of connecting in series the further drive coil.

Furthermore, the method comprises the steps of decoupling the first drive coil connected in the step of connecting in series the drive coil of the first of the n contactors from the adjustable holding voltage source, and ending the disconnection operation as soon as the first drive coil has been decoupled from the adjustable holding voltage source.

Furthermore, the disclosure provides a battery comprising a drive circuit according to the disclosure, wherein the battery particularly preferably is in the form of a lithium-ion battery. Advantages of such batteries consist, inter alia, in their comparatively high energy density and their high level of thermal stability. A further advantage of lithium-ion batteries consists in that they are not subject to memory effect.

BRIEF DESCRIPTION OF THE DRAWINGS

Exemplary embodiments of the disclosure will be explained in more detail with reference to the drawings and the description below. In the drawings.

DETAILED DESCRIPTION

Figure 1:
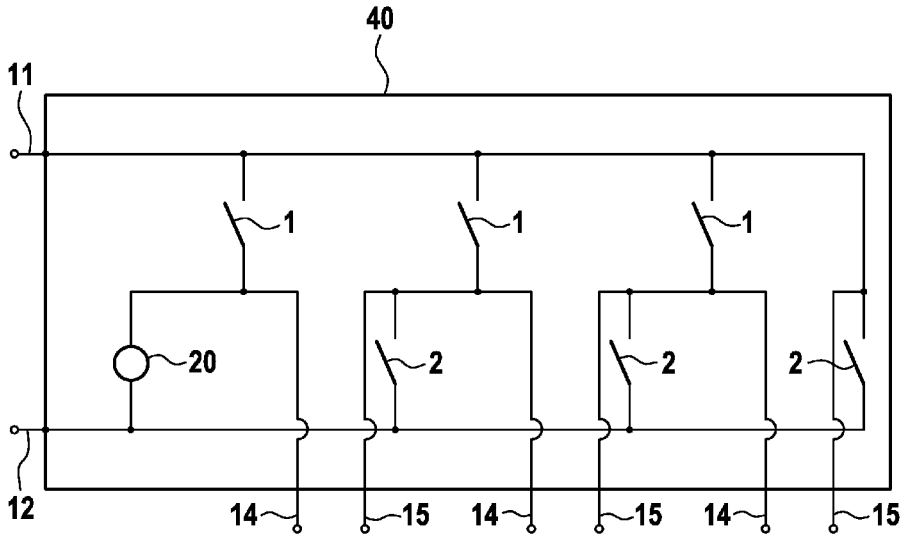
FIG. 1 shows an exemplary embodiment of a drive circuit according to the disclosure.

FIG. 1 shows an exemplary embodiment of a drive circuit 40 according to the disclosure. Said drive circuit has a first input 11 and a second input 12 for connection to an energy store, for example a voltage source. In this exemplary embodiment, the drive circuit 40 according to the disclosure has, purely by way of example, three first and three second connections 14 and 15, wherein in each case a first and a second connection 14, 15 form a connection pair. The drive circuit 40 according to the disclosure is connectable to the connections of, in this exemplary embodiment, three drive coils of three contactors via the first and second connections 14, 15. In this exemplary embodiment, the drive circuit according to the disclosure has three first switching means 1 and three second switching means 2. In each case one first switching means 1 and one second switching means 2 are assigned to a connection pair. The first connections of the first switching means 1 are connected to the first input 11 of the drive circuit 40. The second connections of the first switching means 1 are each connected to the first connection 14 of the assigned connection pair. The first connections of the second switching means 2 are connected to the second input 12 of the drive circuit 40, while the second connections of the second switching means 2 are each connected to the second connection 15 of the assigned connection pair. In addition, the second connection 15 of the first connection pair of the drive circuit 40 is connected to the first connection 14 of the second connection pair, while the second connection 15 of the second connection pair is connected to the first connection 14 of the third connection pair. If the connections 14, 15 of the three connection pairs are therefore each connected to one of the connections of in each case one connection pair of a drive coil, the in total three drive coils are in series within the drive circuit 40. The drive circuit 40 also has an adjustable holding voltage source 20, whose first terminal is connected to the second input 12 of the drive circuit 40, while the second terminal of the adjustable holding voltage source 20 is connected to the first of the first connections 14, i.e. the first connection 14 of the first connection pair. If the drive circuit 40 is therefore connected to three drive coils, said drive coils can either be connected in parallel with an energy store, if connected, or in series with the adjustable holding voltage source 20, depending on the switching state of the first and second switching means 1, 2. In the attraction phase, purely by way of example the connections of the first drive coil can be connected directly to the inputs 11, 12 of the drive circuit 40 by closing of the first first and the first second switching means 1, 2. If the drive circuit 40 is connected to an energy store, for example a voltage source, the first drive coil can therefore be connected in parallel with this voltage source. An attraction current then flows through said drive coil, so that the contactor associated with this drive coil safely attracts or closes. If the contactor is attracted, the drive coil can be connected in series with the adjustable holding voltage source 20 by virtue of the first first switching means 1 opening and the adjustable holding voltage source 20 being brought into operation, so that a relatively low holding current flows through said drive coil.

Figure 2:
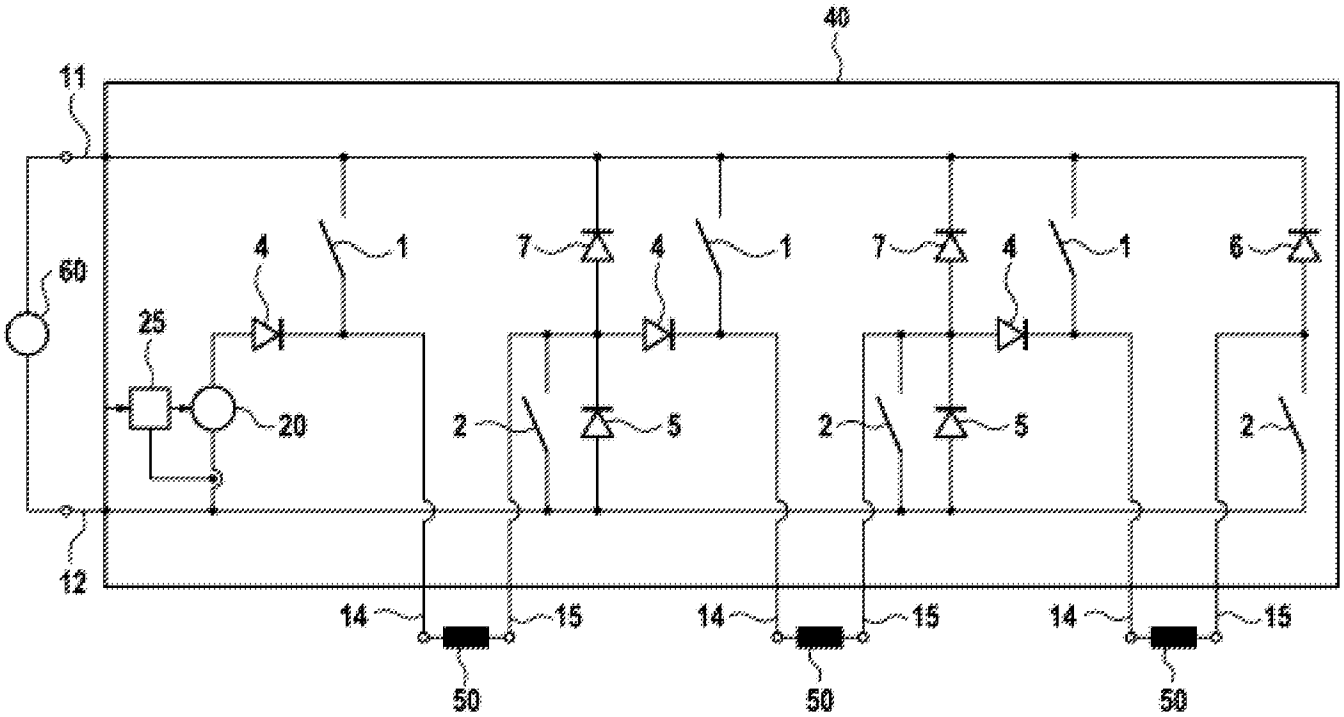
FIG. 2 shows a specific exemplary embodiment of a drive circuit according to the disclosure.

FIG. 2 shows a specific exemplary embodiment of a drive circuit 40 according to the disclosure. This drive circuit 40 according to the disclosure is substantially identical to that shown in FIG. 1, but has a further circuitry with different components or units. The components with identical designations in FIG. 2 therefore correspond to those in the first exemplary embodiment in FIG. 1, so that which has been mentioned there in respect of these components can also be transferred to the second exemplary embodiment in FIG. 2. Therefore, no reference is made in the description relating to FIG. 2 to most of the components with the same designations. In the exemplary embodiment of a drive circuit 40 according to the invention disclosure in FIG. 2, the drive circuit 40 is connected to in total three drive coils 50 and to an energy store 60 in the form of a voltage source. Neither the drive coils 50 nor the energy store 60 are part of the drive circuit 40 according to the disclosure. In this specific exemplary embodiment of a drive circuit 40 according to the disclosure, the adjustable holding voltage source 20 is connected to an optional measurement and actuation unit 25. This is designed to measure the actual current flowing through the electrical connection between the first terminal of the holding voltage source 20 and the second input 12 of the drive circuit 40 and to compare this actual current with a predetermined setpoint current. The measurement and actuation unit 25 is furthermore designed to adjust the holding voltage generated by the adjustable holding voltage source 20 depending on the result of the comparison between the actual current and the setpoint current. In addition, the drive circuit 40 according to the disclosure in this exemplary embodiment comprises three diodes 4, wherein in each case one diode 4 is assigned to a connection pair. The first of the diodes 4 is arranged in the electrical connection between the second terminal of the adjustable holding voltage source 20 and the first of the first connections 14, i.e. the first connection 14 of the first connection pair. The remaining diodes 4 are each in the electrical connections between in each case the second connection 15 of a first connection pair and the in each case first connection 14 of a second adjacent connection pair. In this case, the cathodes of the three diodes 4 are each connected to a second connection of that first switching means 1 which is assigned to that connection pair which is also assigned to the respective diode 4. In addition, the drive circuit according to the disclosure in this exemplary embodiment comprises two freewheeling diodes 5, which are each connected in parallel with the first and second second switching means 5. In this case, the anodes of the freewheeling diodes 5 are each connected to the second input 12 of the drive circuit 40, while the cathodes of the freewheeling diodes 5 are each connected to the electrical connections between in each case the second connection 15 of a respective first connection pair and the respective first connection 14 of a respective second, adjacent connection pair. Furthermore, the drive circuit 40 according to the disclosure in the exemplary embodiment shown in FIG. 2 has two further freewheeling diodes 7, wherein the first further freewheeling diode 7 is assigned to the second connection pair, and the second further freewheeling diode 7 is assigned to the third connection pair. In this case, the cathodes of the further freewheeling diodes 7 are connected to the first input 11 of the drive circuit 40, while the anodes of the further freewheeling diodes 7 are each connected to the cathode of the freewheeling diode 5 assigned to the same connection pair, the anode of the diode 4 assigned to the same connection pair and the second connection 15 of the connection pair assigned to the further freewheeling diode 7. In addition, the last second connection 15 of the last third connection pair is connected to the anode of a further diode 6, while the cathode of this further diode 6 is connected to the first input 11 of the drive circuit 40.

Possible operation of the drive circuit 40 according to the disclosure in the exemplary embodiment shown in FIG. 2 starts with the beginning of a switch-on operation.

For this purpose, first the first drive coil 50 of the first of the three contactors is connected in parallel with the energy store 60 by closing of the first first switching means 1 and of the first second switching means 2. If the mentioned first drive coil 50 is connected in parallel with the energy store 60, a high attraction current flows through said first drive coil, so that the first contactor associated with the first drive coil 50 is attracted. Thereupon, the first drive coil 50 of the first of the three contactors is connected in series with the adjustable holding voltage source 20, and the above-described parallel circuit is interrupted once a predetermined duration T has elapsed, said duration corresponding in this exemplary embodiment to the ratio of the inductance of the first drive coil 50 of the first contactor to the equivalent resistance of the first drive coil 50 of the first contactor. For this purpose, the first first switching means 1 is opened and the adjustable holding voltage source 20 is brought into operation. The first second switching means 2 initially remains closed. As a result, the first drive coil 50 of the first contactor is connected in series with the adjustable holding voltage source 20 and a holding current flows through said drive coil, with the result that the first contactor is held in the closed state. Then, a further drive coil 50, in this case the second drive coil 50 of the second contactor, is connected in parallel with the energy store 60 by virtue of the first and second switching means 1, 2 in the second group of in each case two switching means 1, 2, i.e. the second first and the second second switching means 1, 2, being closed. Therefore, the second contactor is also attracted. After a predetermined duration T, which now corresponds to the ratio of the inductance of the second drive coil 50 of the second contactor to the equivalent resistance of the second drive coil 50 of the second contactor, the second first switching means 1 and the first second switching means 2 are opened, as a result of which the second drive coil 50 is connected exclusively in series with the first drive coil 50 and the adjustable holding voltage source 20. The holding voltage generated by the adjustable holding voltage source 20 is increased so that the holding current flowing through the drive coils 50 or the actual current always corresponds to a predetermined setpoint current. For this purpose, the measurement and actuation unit 25 measures and compares the actual current flowing through the series circuit comprising the drive coils 50 and the adjustable holding voltage source 20 with a predetermined setpoint current and, in the event of a discrepancy, increases the actual current until it corresponds to the setpoint current. Next, as described above already for the first and second drive coils 50, the third drive coil 50 is then, having previously been connected in parallel with the energy store 60, is connected in series with the adjustable holding voltage source 20 and the holding voltage generated by the adjustable holding voltage source 20 is further increased. The switch-on operation is ended as soon as the three drive coils 50 of the three contactors are connected in series with one another and in series with the adjustable holding voltage source 20 and the holding current flowing through the drive coils 50, i.e. the actual current flowing through the drive coils 50, corresponds to the predetermined setpoint current. In this exemplary embodiment, the predetermined setpoint current, purely by way of example, corresponds to a holding current which is required as a minimum for holding the contactors during the holding phase. If the three contactors are intended to be opened, the drive coils 50 are decoupled from the holding voltage source 20 in the reverse order from that in which they were connected to form the series circuit. For this purpose, in each case the switching means 1, 2 within the groups of in each case two switching means 1, 2 are opened successively, beginning with the last group, i.e. the third first and the third second switching means 1, 2. If the third drive coil 50 has been decoupled, the adjustable holding voltage source 20 reduces the actual current to the setpoint current. Then, the second drive coil 50 is decoupled, as described above for the third drive coil 50, and the holding current or the actual current through the series circuit is reduced again. Finally, the first of the drive coils 50 is decoupled in the described manner and the adjustable holding voltage source 20 is disconnected.

In the specific exemplary embodiment of a drive circuit 40 according to the disclosure in FIG. 2, all of the diodes 4, all of the freewheeling diodes 5, the further diode 6 and the further freewheeling diodes 7 are optional for the implementation of a drive circuit 40 according to the disclosure. Drive circuits 40 according to the disclosure can also be implemented without the diodes 4, 5, 6 and 7. In addition, the arrangement of the diodes 4, 5, 6 and 7 in this exemplary embodiment is selected purely by way of example. The diodes 4, 5, 6 and 7 can also be arranged at another point within the drive circuit 40 according to the disclosure. In addition, the measurement and actuation unit 25 is optional for the implementation for a drive circuit 40 according to the disclosure.

In all of the exemplary embodiments, a drive circuit 40 according to the disclosure can also have more than three, for example 10 or n connection pairs for connection to n drive coils 50. The operation of the drive circuit 40 can then be performed in the described manner for these 10 or n connection pairs or for 10 or n drive coils 50, for example.

The invention claimed is:

1. A drive circuit for n contactors, n being a natural number, the drive circuit comprising:

a first input and a second input, the first input being configured to connect to a first terminal of an energy store and the second input being configured to connect to a second terminal of the energy store;

n first connections and n second connections, each first connection of the n first connections being configured to connect to a first terminal of a drive coil of one of the n contactors and each second connection of the n second connections being configured to connect to a second terminal of the drive coil of the one of the n contactors;

n first switches having a first terminal and a second terminal, the first terminal of each first switch of the n first switches being connected to the first input and the second terminals of i-th first switches of the n first switches being connected to i-th first connections of the n first connections, i being all natural numbers greater than zero and less than or equal to n;

n second switches having a first terminal and a second terminal, the first terminal of each second switch of the n second switches being connected to the second input and the second terminals of i-th second switches of the n second switches being connected to i-th second connections of the n second connections, i-th second connections of the n second connections being connected to (i+1)-th first connections of the n first connections; and an adjustable holding voltage source having a first terminal connected to the second input and a second terminal connected to a first of the n first connections.

2. The drive circuit as claimed in claim 1, further comprising:

a measurement and actuation unit connected to the adjustable holding voltage source and which is configured to (i) measure a first current flowing between the first terminal of the adjustable holding voltage source and the second input, and (ii) adjust a holding voltage of the adjustable holding voltage source based on a comparison of the first current with a predetermined setpoint current.

3. The drive circuit as claimed in claim 1, further comprising:

n first diodes having an anode and a cathode, the anodes of i-th first diodes of the n first diodes being connected to the second terminals of i-th second switches of the n second switches and the cathodes of i-th first diodes of the n first diodes being connected to the second terminals of (i+1)-th first switches of the n first switches.

4. The drive circuit as claimed in claim 1, further comprising:

n−1 second diodes, i-th second freewheeling diodes of the n−1 second diodes being connected in parallel with i-th second switches of the n switches for values of i less than n.

5. The drive circuit as claimed in claim 4, wherein:

the n−1 second diodes are zener diodes; and the drive circuit further comprises a further zener diode connected in parallel with an n-th second switch of the n second switches, an anode of the further zener diode being connected to the second input.

6. The drive circuit claimed in claim 1, further comprising:

a third diode having an anode and a cathode, the anode of the third diode being connected to an n-th second connection of the n second connections and the cathode of the third diode being connected to the first input.

7. The drive circuit as claimed in claim 3, further comprising:

n fourth diodes having an anode and a cathode, the cathode of each fourth diode of the n fourth diodes being connected to the first input and the anodes of i-th fourth diodes of the n fourth diodes being connected to the cathodes of i-th second diodes of the n−1 second diodes and to i-th second connections of the n second connections.

8. A method for driving n contactors comprising:

connecting a drive coil of a first contactor of the n contactors in parallel with an energy store using a first group two switches;

connecting the drive coil of the first contactor of the n contactors in series with an adjustable holding voltage source;

interrupting a parallel circuit comprising the drive coil of the first contactor of the n contactors and the energy store using the first group two switches in response to a predetermined duration elapsing; and for each further contactor of the n contactors, in numerical order from a second contactor of the n contactors to an n-th contactor of the n contactors:

connecting a drive coil of the further contactor of the n contactors in parallel with the energy store using a further group of two switches;

connecting the drive coil of the further contactor of the n contactors in series with the adjustable holding voltage source and with the drive coil of the first of the n contactors;

interrupting a parallel circuit comprising the drive coil of the further contactor of the n contactors and the energy store using the further group two switches in response to a further predetermined duration elapsing; and increasing a holding voltage of the adjustable holding voltage source.

9. The method for driving n contactors as claimed in claim 8, wherein:

the predetermined duration is equal to the inductance of the drive coil of the first contactor of the n contactors divided by the equivalent resistance of the drive coil of the first contactor of the n contactors; and for each of the further contactors of the n contactors, the further predetermined duration is equal to the inductance of the drive coil of the further contactor of the n contactors divided by the equivalent resistance of the drive coil of the further contactor of the n contactors.

10. The method for driving n contactors as claimed in claim 8, the increasing further comprising:

increasing the holding voltage such that a current flowing through a series circuit comprising the adjustable holding voltage source and the further drive coil is equal to a predetermined setpoint current.

11. The method for driving n contactors as claimed in claim 8, further comprising:

for each further contactor of the n contactors, in reverse numerical order from an n-th contactor of the n contactors to the second contactor of the n contactors:

decoupling a drive coil of the further contactor of the n contactors the adjustable holding voltage source by opening a switch of the further group of two switches; and reducing the holding voltage of the adjustable holding voltage source; and decoupling the first drive coil of the first contactor of the n contactors from the adjustable holding voltage source.

12. A battery comprising:

a drive circuit for n contactors, n being a natural number, the drive circuit comprising:

a first input and a second input, the first input being configured to connect to a first terminal of an energy store and the second input being configured to connect to a second terminal of the energy store;

n first connections and n second connections, each first connection of the n first connections being configured to connect to a first terminal of a drive coil of one of the n contactors and each second connection of the n second connections being configured to connect to a second terminal of the drive coil of the one of the n contactors;

n first switches having a first terminal and a second terminal, the first terminal of each first switch of the n first switches being connected to the first input and the second terminals of i-th first switches of the n first switches being connected to i-th first connections of the n first connections, i being all natural numbers greater than zero and less than or equal to n;

n second switches having a first terminal and a second terminal, the first terminal of each second switch of the n second switches being connected to the second input and the second terminals of i-th second switches of the n second switches being connected to i-th second connections of the n second connections, i-th second connections of the n second connections being connected to (i+1)-th first connections of the n first connections; and an adjustable holding voltage source having a first terminal connected to the second input and a second terminal connected to a first of the n first connections.

* * * * *